United States Patent [19]

Long et al.

[11] 4,379,731

[45] Apr. 12, 1983

[54] METHOD AND APPARATUS FOR APPLYING HOT MELT ADHESIVE TO BASE CUPS

[75] Inventors: Geoffrey A. D. Long, Dunwoody; Brian C. McPike, Douglass, both of Ga.

[73] Assignee: Sewell Plastics, Inc., Atlanta, Ga.

[21] Appl. No.: 292,835

[22] Filed: Aug. 14, 1981

[51] Int. Cl.[3] ..... B05B 1/20

[52] U.S. Cl. ..... 156/356; 118/302; 118/317; 118/323; 156/357; 156/578

[58] Field of Search ..... 156/578, 357, 356; 118/317, 323, 302; 425/809

[56] References Cited

U.S. PATENT DOCUMENTS

| | | | |
|---|---|---|---|
| 2,907,300 | 10/1959 | Alholm et al. | 118/323 |
| 2,926,723 | 3/1960 | Clark | 118/302 X |
| 3,044,894 | 7/1962 | Makowski et al. | 118/317 X |
| 3,094,254 | 6/1963 | Cullen et al. | 118/323 X |
| 4,247,357 | 1/1981 | Konty | 156/578 X |

*Primary Examiner*—David A. Simmons

*Attorney, Agent, or Firm*—Barnes & Thornburg

[57] ABSTRACT

An applicator for use in an apparatus for assembling containers into cup-shaped bases is disclosed. The applicator coats a contact surface of each base with a bonding agent preparatorily to placement of a corresponding container therein. The applicator includes a support fixed adjacent a supply of cup-shaped bases, and a pivot rotationally supported by the support in alignment with the open end of one of the cup-shaped bases. A nozzle is fixed to the pivot and is rotatable therewith for ejecting a bonding agent into the cup-shaped bases. A piston in a cylinder connected to the base connects to a crank on the pivot for rotating the nozzle with respect to the cup-shaped base. A control is connected to the nozzle and to the piston for causing the nozzle to rotate and eject a bonding agent simultaneously.

10 Claims, 5 Drawing Figures

METHOD AND APPARATUS FOR APPLYING HOT MELT ADHESIVE TO BASE CUPS

This invention relates generally to machines for assembling containers, particularly blow-molded plastic bottles for beverages and the like, into complementary cup-shaped bases or heels. The invention relates in particular to an applicator means for coating a contact surface of each base with a bonding agent preparatory to placement of a corresponding container into the base.

In recent years, the use of blow-molded plastic bottles for containing liquids at ambient and elevated pressures have found increasing acceptance, particularly in the beverage industry. Typically, the blow-molded plastic bottles are provided with a substantially hemispherically shaped bottom principally for reasons of structural strength and economy. Marketing considerations require that these bottles stand erect on their bottoms, and to achieve this, it is typical to attach to the bottom of each bottle a cup-shaped base or heel which will permit the bottle to stand upright. While some bottles and base cups have been designed to include frictionally engaging surface features which permit the base cup to snap onto the bottle (see U.S. Pat. No. 4,096,620), the predominant method of attachment is with the aid of hot melt adhesives, typically diisocyanate-modified polyesters.

Two examples of machines for assembling bottles and base cups together which employ an adhesive applicator are to be found in U.S. Pat. Nos. 4,132,584 and 4,247,357. Typically, the adhesive has been applied to the base cup by spraying three or four dots of adhesive onto a support ring located at the bottom of the base cup. Alternatively, two to four dots of glue were sprayed on the interior wall of the base cup a short distance below the lip. In practice, it was found that the dot application of adhesives was not always satisfactory, with the consequence being the separation of the base cup from the bottle.

Recently, two manufacturers (B & H Manufacturing and Aidlin Automation) have introduced machines which include means for rotating a base cup under the nozzle of the hot melt adhesive applicator, thus obtaining an annular ring of hot melt adhesive. While the newly introduced B & H machines perform satisfactorily in the intended manner, the Aidlin machine system is yet in the customer testing program. Disadvantages have been identified with both systems. First, the purchase price of the new machines with the base cup rotation feature is about (30%) above market price for machines without the feature (B & H have not offered a machine without this feature so the price difference is estimated in their case based on current prices of Aidlin, Anderson, and Count-O-Matic machines). Secondly, retrofit of existing Aidlins, Count-O-Matic, or Anderson base cup applicator machines using the B & H or Aidlin systems is mechanically impractical except Aidlin to Aidlin, which costs close to the cost of the basic machine. Thirdly, the operating parts of the machine which cause the base cup to rotate are hidden from normal visual inspection and preventive maintenance, but are subject to malfunction caused by misapplication of the hot melt adhesive, particularly in the prototype Aidlin machines.

It has also been known to replace the dot-spraying nozzle with one which sprays a continuous ring of adhesive. The ring-spraying nozzles have performed erratically and generally have not been adopted in the industry.

It is an object of the present invention to overcome the disadvantages of the prior art with an applicator designed to project an annular ring of hot melt adhesive, the moving parts of which are easily visible for inspection and preventive maintenance, and to provide such an apparatus which is easily added to existing machinery at low cost yet with high reliability.

The objects of the present invention are generally satisfied by an applicator means which includes a support fixed to the assembly apparatus adjacent to a supply of the cup-shaped bases. A pivot means is provided which is rotationally supported by the support in alignment with the open end of the cup-shaped bases. A nozzle means is fixed to the pivot means and rotatable therewith for ejecting a bonding agent into the cup-shaped bases. A rotating means is connected to the support and to the pivot means for rotating the nozzle with respect to the cup-shaped base. A control means is provided which is connected to the nozzle means and to the rotating means for causing the nozzle means to rotate and eject a bonding agent simultaneously. A heater means is fixed adjacent the nozzle for rotation therewith for maintaining the proper temperature of the bonding agent in the vicinity of the nozzle. A thermostatic means is fixed to the nozzle means and situated in fixed relationship to the heater means and connected thereto for controlling the temperature of the bonding agent.

In the preferred embodiment of the present invention, the support includes a substantially horizontal member extending above a supply of the cup-shaped bases. The pivot means is rotationally supported by the horizontal member in substantially vertical relationship above the cup-shaped bases. The nozzle holder is fixed to the bottom of the pivot means and includes a cavity for containing the nozzle, a pair of cavities for containing the heaters, the heater cavities being situated on opposite sides of the nozzle cavity in such a geometric relationship as to easily maintain the desired thermal conditions for the hot melt adhesive.

The rotating means preferably comprises an air-actuated cylinder connected to the support and to a crank attached to the pivot. The air cylinder is connected to the same supply of air as is the nozzle such that the control means causes the nozzle to rotate and eject a bonding agent simultaneously. In the preferred embodiment, the nozzle would be caused to rotate in one direction during a first ejection of bonding agent and then rotate in the opposite direction on the next subsequent ejection of bonding agent. This reciprocal rotational motion of the nozzle is sufficient to lay down an annular ring of bonding agent on the inside of a base cup, yet simple enough to avoid any unnecessary complicated electrical, hydraulic, or pneumatic connections.

The accompanying drawings illustrate the invention in its environment, and show a preferred embodiment exemplifying the best mode of carrying out the invention as presently perceived. In such drawings.

Figure 1:
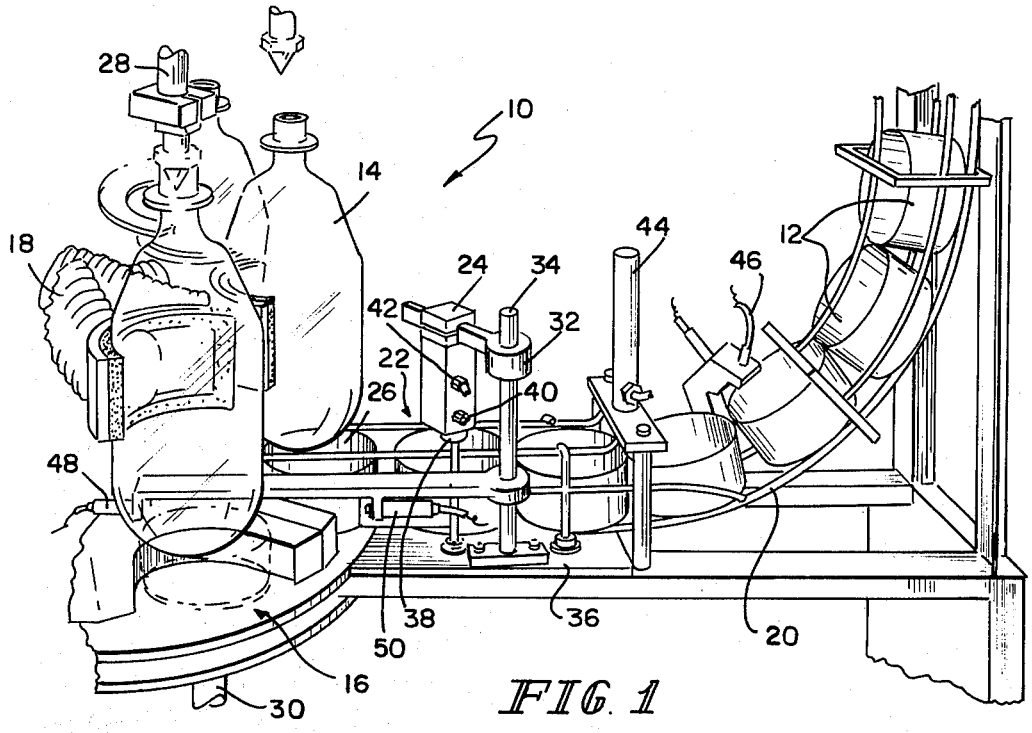
FIG. 1 PRIOR ART
FIG. 1 is a perspective detail view of a prior art apparatus showing the environment of the invention.
Figure 2:
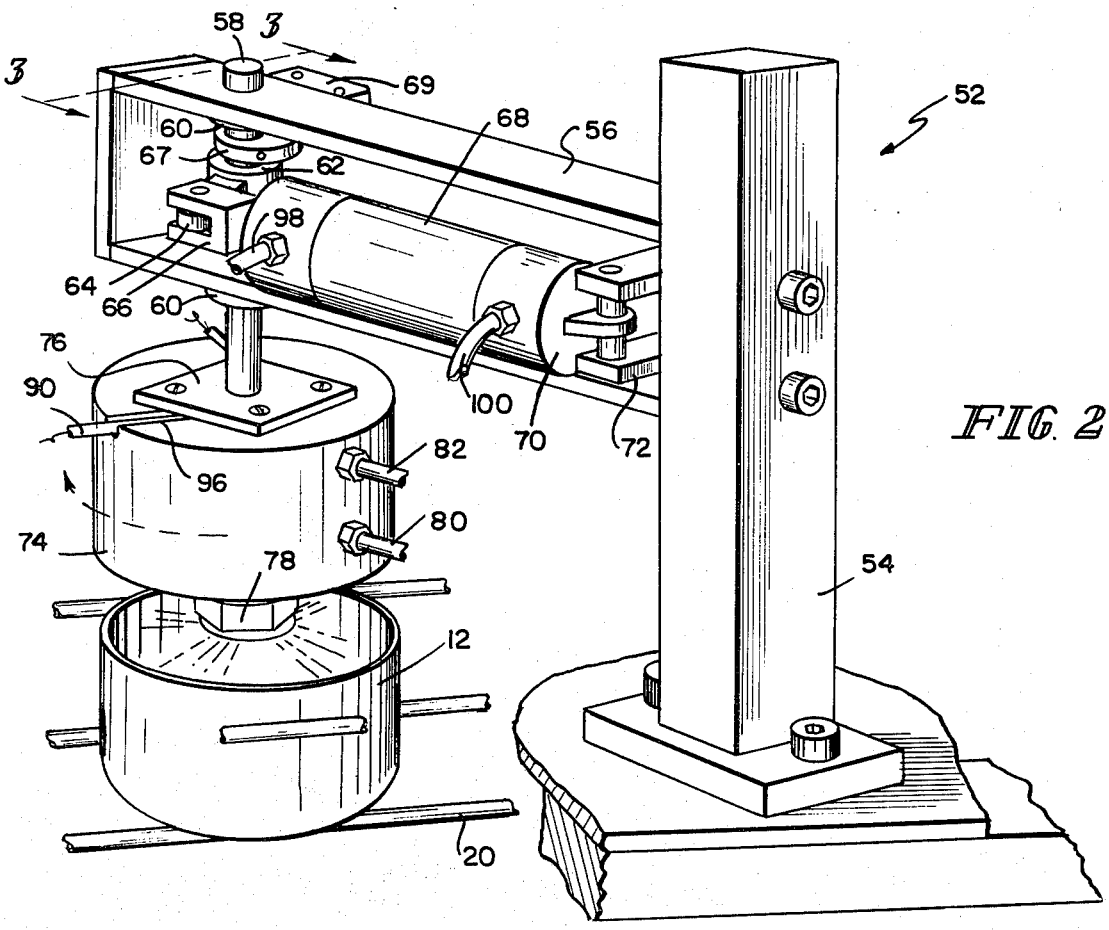
FIG. 2 is a perspective view of the preferred embodiment of the invention as it might be employed in connection with the prior apparatus shown in FIG. 1.
Figure 3:
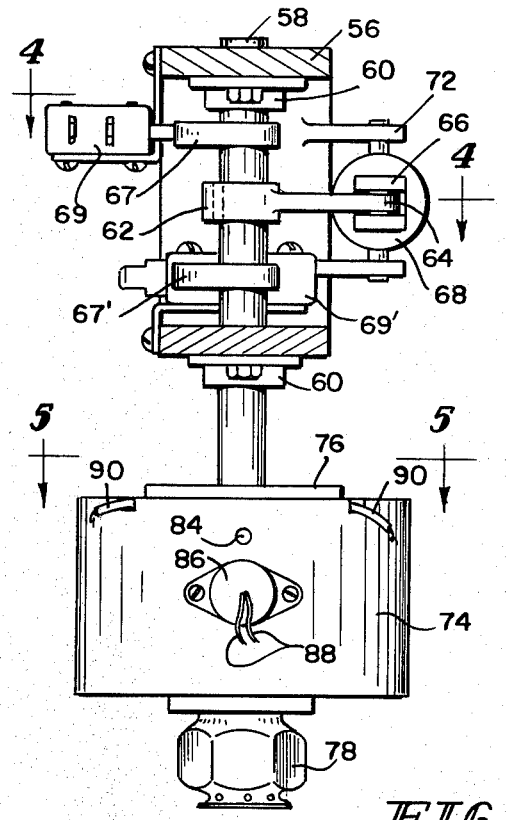
FIG. 3 is a sectional detail of the apparatus shown in FIG. 2 as viewed along line 3—3.

The environment of the present invention is shown in FIG. 1, which is a partial perspective view of that portion of a container-base cup assembly machine 10 wherein the cups 12 are fed into the machine 10 for assembly to the containers 14. In a typical machine 10, a supply of containers 14 is transported to the assembly location 16 by a first conveyor means 18. A second conveyor means 20 conveys a supply of base cups to a feeding station 22 adjacent the first conveyor means 18. An applicator means 24 is situated with respect to the feeding station 22 so as to be directly above the open end of a base cup. When a base cup 12 is in the feeding station 22, a hot melt adhesive or other bonding agent is applied by the applicator means 24. The cup is then transported to a pre-assembly location 26 axially beneath a bottle 14. The bottle 14 and base cup 12 are then moved to the assembly position 16, and the base cup and bottle axially moved toward each other by means of either an overhead plunger 28 or a cup elevator 30, or both.

The adhesive applicating mechanism 24 is typically adjustably supported on radial arm 32 which is in turn vertically adjustably mounted on upstanding post 34 suitably mounted on a frame 36 adjacent the base cup supply conveyor means 20. The applicator 24 included a spray nozzle 38, a first inlet 40 connected to a supply of molten adhesive, and a second inlet 42 connected through an appropriate control means (not shown) to a supply of pressurized air which operated the applicator 24 so as to deposit a desired amount of adhesive on the inner surface of the cup 12 situated in the feeding station 22. Sensing means 44 are provided to determine the presence of a cup next adjacent the feeding station 22 so as to prevent the untimely deposit of hot melt adhesive onto the conveyor means 20 in the event that the feeding station 22 is not being properly supplied with base cups 12. Further, an additional detecting means 46 can be employed to ensure that the base cups 12 are situated on the conveying means 20 with the proper side available to receive the adhesive. Additional detecting means 48 and 50 can also be employed to ensure that the cups are moving in a correct manner from the feeding station 22 to the assembly location 16.

A preferred embodiment of an improved applicator means 52 is shown in FIGS. 2–5, and the same reference numerals will be used throughout to indicate the same portions of the apparatus. The applicator 52 is supported adjacent a supply of the cup-shaped bases 12 by vertical support 54. A horizontal box member 56 extends outwardly from support 54 over conveyor 20. A pivot 58 is rotationally supported in the box member 56 by appropriate journals 60 in alignment with the open end of one of the cup-shaped bases 12. A crank 62 is fixed to pivot pin 58, the arm 64 of crank 62 being engaged by clevice 66 on the end of the push rod of a double-acting cylinder 68. The fixed end 70 of cylinder 68 is attached by bracket 72 to the box support 56. The position of crank 62 can be determined by cams 67, 67' mounted on pivot pin 58 interacting with microswitches 69, 69'.

A cylindrical nozzle block 74 is fixed to the bottom of the pivot pin 58 with the aid of a support plate 76 such that rotation of pivot pin 58 by crank 62 also causes rotation of nozzle block 74. A standard Nordson Packing Cartridge #153-012 and nozzle Model No. 708-700 designated in the drawing as 78 (used on a Nordson H20A non-rotating gun) is included in the nozzle block 74 in axial alignment with pivot pin 58. At one point on the periphery of nozzle block 74, a conduit 80 is provided for supplying hot melt adhesive from a pressurized reservoir (not shown). A second conduit 82 is connected to a supply of pressurized air for operating the valve and nozzle 78. Diametrically opposite the conduits 80 and 82 there is provided an air escape vent 84 for release of the valve-controlling pressurized air at appropriate intervals. There is further provided a thermostat 86 for sensing the temperature of valve block 74. The thermostat 86 is connected by wires 88 to an appropriate source of electrical power and to wires 90, which in turn are connected to heaters 92 and 94 situated in appropriate recesses in nozzle block 74. The optimum design for nozzle block 74 is such that heaters 92 and 94 are situated in block 74 on a line approximately orthagonal to the line from conduit 80 to thermostat 86. In this manner, the distance from heaters 92 and 94 to the nozzle 78 is approximately the same as the distance from heaters 92 and 94 to thermostat 86. This close proximity of the thermostat 86, nozzle 78, and heaters 92 and 94 permits a very accurate regulation of the temperature of the hot melt adhesive to be supplied to the cups. To permit the mounting of nozzle block 74 to support 76, the heater wires 90 are recessed into slots 96 provided in the top surface of nozzle block 74.

Figure 5:
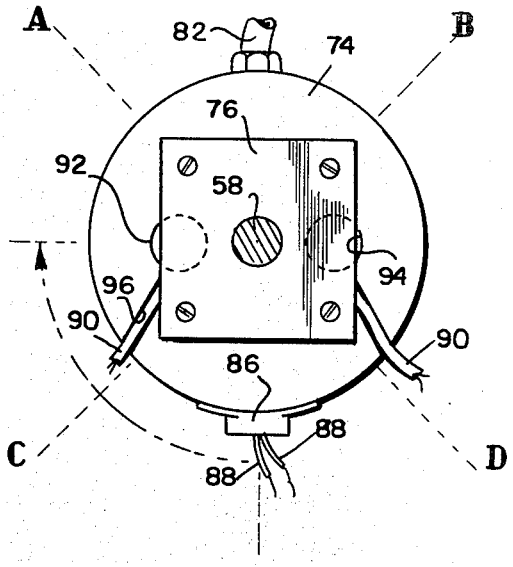
FIG. 5 is a sectional detail view of the apparatus illustrated in FIG. 3, taken along line 5—5.
Figure 4:
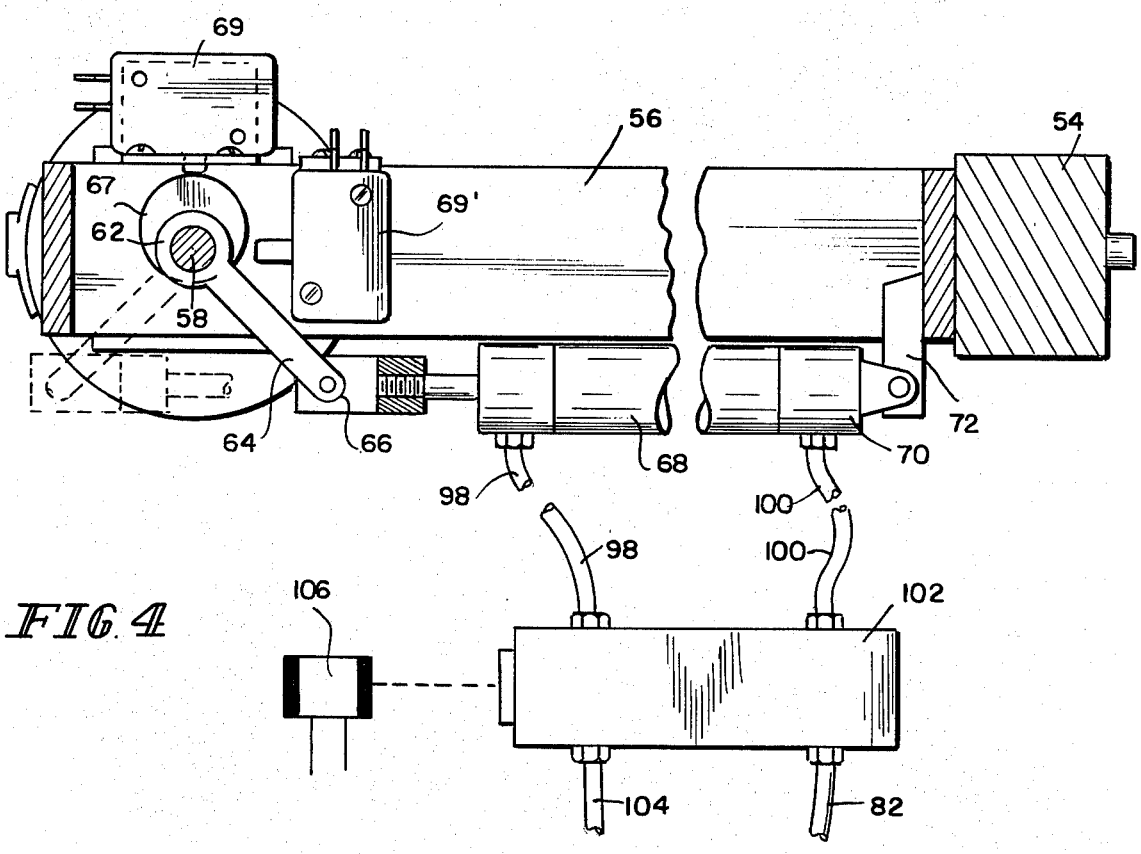
FIG. 4 is a sectional detail of the apparatus illustrated in FIG. 3, taken along line 4—4.

The Nordson Packing Cartridge #153-012 and nozzle Model No. 708-700 provide for the ejection of four discrete streams of hot melt adhesive shown in FIG. 5 by the letters A, B, C, and D, which streams are separated from each other by approximately 90°. The streams are ejected from valve 78 when pressurized air is present in conduit 82, and is not ejected in the absence of such air pressure.

The double-acting cylinder 68 has conduits 98 and 100 attached to the ports on either end of the cylinder. The opposite ends of conduits 98 and 100 are connected to a two-position four-way valve 102 to which is also connected a branch of conduit 82 and an exhaust conduit 104. With valve 102 in a first position, the presence of pressurized air in line 82 causes air to enter conduit 100 and exhaust from conduit 98, thereby causing the crank 62 to move from the position shown in FIG. 4 in solid lines to the position shown in FIG. 4 in phantom. With valve 102 in its second position, the presence of air in line 82 causes air to enter cylinder 68 through line 98 and to exhaust from line 100, thereby moving the crank from the position shown in phantom in FIG. 4 back to the position illustrated in solid lines. In this manner, the presence of air pressure in line 82 causes nozzle 78 to eject adhesive at the same time as it is being rotated through an arc of approximately 90° by the action of crank 62 and cylinder 68, thereby causing four 90° arcs of adhesive to be distributed, thus forming an annular ring of adhesive within the cup 12.

Valve 102 is preferably manipulated by an electrical mechanism 106 connected to an appropriate sensing means such as that illustrated at 44 in FIG. 1 to assure that the adhesive is only distributed when a cup is actually present underneath the nozzle. Further, limit switches 69, 69' are provided mounted on box member 56 which sense the two end positions of the rotation of valve block 74 by means of cams 67 and 67' so as to terminate the supply of air through line 82 as soon as that end position is achieved. The cams 67 and 67' can be adjusted so as to provide the exact rotational displacement desired.

It will be appreciated by those skilled in the art that variations to the invention here described could be employed without departing from the spirit of the invention. For example, while the Nordson valve and nozzle employed causes four streams of adhesive to be ejected approximately 90° apart, other valves may be available which would eject a differing number of streams at a different angle relationship yet, if rotated through the proper angle, would effect the same result, e.g., three streams ejected 120° apart and rotated through 120°. Further, while the rotating means illustrated involves a crank and double-acting cylinder, other equivalent means, such as spur and bevel gears mounted on appropriate shafts and connected to a dual-directional electrical motor, could also be employed. While other rotating means can be employed, the simplicity provided by the illustrated system is to be found in the use of the same supply of air through conduit 82 to both actuate the nozzle 78 and rotate the nozzle through the desired arc.

Other variations and modifications of the present invention will become apparent to those skilled in the art, and it is not intended that the invention be unduly limited by this description of the preferred embodiment. It is instead intended that the invention be defined by the means and their obvious equivalents set forth in the following claims.

What is claimed is:

1. In an apparatus for assembling containers into cup-shaped bases, an applicator means for coating a contact surface of each base with a bonding agent preparatorily to placement of a corresponding container therein, the applicator means comprising:

(a) a support fixed to said apparatus adjacent the supply of cup-shaped bases, (b) pivot means rotationally supported by the support in alignment with the open end of one of the cup-shaped bases, (c) nozzle means fixed to said pivot means and rotatable therewith for ejecting a bonding agent into the cup-shaped bases, (d) rotating means connected to the support and to the pivot means for rotating the nozzle with respect to the cup-shaped bases, and (e) control means connected to the nozzle means and to the rotating means for causing the nozzle means to rotate and eject a bonding agent simultaneously, the control means comprising a cam fixed to rotate with the pivot means and a switch means operated by the said cam.

2. The applicator means of claim 1 wherein the nozzle means comprises an air-actuated nozzle for dispensing an integer number, n, discrete streams of bonding agent and the control means causes the nozzle means to rotate essentially (360/n)° during the dispensing of the bonding agent.

3. The applicator means of claim 1 wherein the nozzle means comprises an air-actuated nozzle and the rotating means comprises an air-actuated cylinder, both the nozzle means and the rotating means being connected through the control means to a common source of pressurized air.

4. The applicator means of claim 1 wherein the control means comprises a two-position four-way valve and the rotating means comprises a double-acting cylinder connected to said valve such that the piston in the cylinder is caused to move in opposite directions on sequential operations of the applicator means.

5. In an apparatus for assembling containers into cup-shaped bases, an applicator means for coating a contact surface of each base, with a bonding agent preparatorily to placement of a corresponding container therein, the applicator means comprising:

(a) a support fixed to said apparatus adjacent the supply of cup-shaped bases, (b) pivot means rotationally supported by the support in alignment with the open end of one of the cup-shaped bases, (c) an air-actuated nozzle fixed to said pivot means and rotatable therewith for ejecting a bonding agent into the cup-shaped bases, (d) an air-actuated cylinder connected to the support and to the pivot means for rotating the nozzle with respect to the cup-shaped bases, and (e) control means for causing the nozzle to rotate and eject a bonding agent simultaneously, both the nozzle and the air-actuated cylinder being connected through the control means to a common source of pressurized air.

6. In an apparatus for assembling containers into cup-shaped bases, an applicator means for coating a contact surface of each base, with a bonding agent preparatorily to placement of a corresponding container therein, the applicator means comprising (a) a support fixed to said apparatus adjacent the supply of cup-shaped bases, (b) pivot means rotationally supported by the support in alignment with the open end of one of the cup-shaped bases, (c) nozzle means fixed to said pivot means and rotatable therewith for ejecting a bonding agent into the cup-shaped bases, (d) a double-acting cylinder connected to the support and to the pivot means for rotating the nozzle with respect to the cup-shaped bases, and (e) a two-position four-way valve connected to said double-acting cylinder for causing the nozzle means to rotate and eject a bonding agent simultaneously, such that the piston in the cylinder is caused to move in opposite directions in sequential operations of the applicator means.

7. In an apparatus for assembling containers into cup-shaped bases, an applicator means for coating a contact surface of each base, with a bonding agent preparatorily to placement of a corresponding container therein, the applicator means comprising:

(a) a nozzle support adapted for rotation about an axis, (b) a nozzle means fixed to the nozzle support on the rotational axis thereof and rotatable therewith for ejecting a bonding agent, (c) a supply of bonding agent connected to the nozzle means, (d) heater means fixed adjacent the nozzle means and rotatable therewith for heating the bonding agent, (e) thermostatic means fixed with respect to the heater means and connected thereto for controlling the temperature of the bonding agent, and (f) means for causing the nozzle means to rotate and eject a bonding agent simultaneously, comprising a position-indicator means fixed to rotate with the nozzle support and a switch means operated by said position-indicating means for controlling the actuation of the nozzle means.

8. The applicator means of claim 7 further comprising a valve block fixed to the nozzle support having a first recess axially therein receiving the nozzle means, and a pair of recesses, one on either side of the first recess, for receiving said heater means at equal distances from the nozzle means.

9. The applicator means of claim 7 further comprising a valve block fixed to the nozzle support having the nozzle means axially received therein, a port on a side of the valve block connected to the supply of bonding agent.

10. The applicator means of claim 9 wherein the thermostatic means is fixed to a side of the valve block opposite the port connected to the supply of bonding agent.

* * * * *